US012611573B2

(12) United States Patent
Ishikawa et al.

(10) Patent No.: US 12,611,573 B2
(45) Date of Patent: Apr. 28, 2026

(54) INFORMATION PROCESSING APPARATUS, INFORMATION PROCESSING METHOD, AND STORAGE MEDIUM

(71) Applicant: BRIDGESTONE SPORTS CO., LTD., Tokyo (JP)

(72) Inventors: Tatsuya Ishikawa, Chichibu (JP); Hiroo Takagi, Chichibu (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 272 days.

(21) Appl. No.: 18/329,110

(22) Filed: Jun. 5, 2023

(65) Prior Publication Data

US 2023/0414998 A1 Dec. 28, 2023

(30) Foreign Application Priority Data

Jun. 23, 2022 (JP) ..... 2022-101299

(51) Int. Cl.
*A63B 24/00* (2006.01)
*A63B 71/06* (2006.01)

(52) U.S. Cl.
CPC ..... *A63B 24/0006* (2013.01); *A63B 2220/10* (2013.01); *A63B 2220/30* (2013.01); *A63B 2220/806* (2013.01)

(58) Field of Classification Search
CPC ..... A63B 24/0006; A63B 2220/10; A63B 2220/30; A63B 2220/806; G09B 19/0038; G06T 2207/30196; G06T 2207/30221; G06T 7/246; G06V 40/23
USPC ..... 473/131, 136, 140, 141, 150, 151, 223, 473/257, 409, 452, 453, 454
See application file for complete search history.

(56) References Cited

U.S. PATENT DOCUMENTS

| | | | | |
|---|---|---|---|---|
| 5,868,578 | A * | 2/1999 | Baum | A63B 24/0021 434/257 |
| 5,904,484 | A * | 5/1999 | Burns | A63B 24/0003 482/901 |
| 7,587,065 | B2 | 9/2009 | Matsumoto et al. | |
| 8,708,833 | B2 | 4/2014 | Ueda | |
| 9,233,291 | B2 | 1/2016 | Kamino | |
| 9,604,142 | B2 * | 3/2017 | Bentley | A63B 24/0006 |
| 10,137,347 | B2 * | 11/2018 | Thornton | A63B 53/04 |
| 10,265,602 | B2 * | 4/2019 | Haas | A63B 69/36 |
| 10,363,470 | B2 * | 7/2019 | Glenn | A61B 5/6895 |

(Continued)

FOREIGN PATENT DOCUMENTS

| | | |
|---|---|---|
| JP | 2002-301172 A | 10/2002 |
| JP | 2004-164563 A | 6/2004 |

(Continued)

OTHER PUBLICATIONS

Communication dated Jan. 13, 2026 in Japanese Application No. 2022-101299.

*Primary Examiner* — Nini F Legesse
(74) *Attorney, Agent, or Firm* — Sughrue Mion, PLLC

(57) ABSTRACT

An information processing apparatus includes an acquisition unit configured to acquire a video of a swing of a golfer who strikes a golf ball with a golf club, a calculation unit configured to calculates a feature amount of the swing from the video, and a conversion unit configured to convert the feature amount into an estimated value of a behavior of a golf club head by substituting the feature amount into a conversion formula.

11 Claims, 14 Drawing Sheets

(56) References Cited

U.S. PATENT DOCUMENTS

| | | | | |
|---|---|---|---|---|
| 2002/0173364 | A1* | 11/2002 | Boscha | A63B 69/3632 473/131 |
| 2004/0096085 | A1 | 5/2004 | Matsumoto et al. | |
| 2009/0208061 | A1 | 8/2009 | Matsumoto et al. | |
| 2015/0238813 | A1* | 8/2015 | Saiki | A63B 24/0003 702/141 |
| 2015/0348591 | A1* | 12/2015 | Kaps | G11B 27/17 386/201 |
| 2016/0074703 | A1* | 3/2016 | Shibuya | G06V 40/23 473/409 |
| 2017/0239520 | A1* | 8/2017 | Kodaira | A61B 5/744 |
| 2017/0296869 | A1* | 10/2017 | Kiryu | G16H 20/30 |
| 2020/0222757 | A1* | 7/2020 | Yang | G06V 40/23 |

FOREIGN PATENT DOCUMENTS

| | | | |
|---|---|---|---|
| JP | 2010-127639 | A | 6/2010 |
| JP | 2011-15968 | A | 1/2011 |
| JP | 2012-170547 | A | 9/2012 |
| JP | 2013-052079 | A | 3/2013 |
| JP | 2013-153802 | A | 8/2013 |
| JP | 2013-195310 | A | 9/2013 |
| JP | 2017-179 | A | 1/2017 |
| JP | 2017-23638 | A | 2/2017 |
| JP | 2017-23639 | A | 2/2017 |
| JP | 2017-70366 | A | 4/2017 |
| JP | 2021-371 | A | 1/2021 |
| JP | 2021-108017 | A | 7/2021 |
| WO | 2020/158727 | A1 | 8/2020 |

* cited by examiner

INFORMATION PROCESSING APPARATUS, INFORMATION PROCESSING METHOD, AND STORAGE MEDIUM

CROSS-REFERENCE TO RELATED APPLICATION(S)

This application claims priority to and the benefit of Japanese Patent Application No. 2022-101299 filed on Jun. 23, 2022, the entire disclosure of which is incorporated herein by reference.

BACKGROUND OF THE INVENTION

Field of the Invention

The present invention relates to an information processing technique concerning behavior analysis in the field of golf.

Description of the Related Art

There are proposed various techniques for analyzing a swing operation of a golfer. Japanese Patent Laid-Open No. 2017-023638 discloses a technique of measuring the incident angle and the like of a golf club head and analyzing a swing operation. Japanese Patent Laid-Open No. 2017-023639 discloses a technique of measuring the rotation angle and the like of a golf club and analyzing a swing operation. Japanese Patent Laid-Open No. 2017-070366 discloses a technique of estimating a striking position on a face surface at the time of striking. Japanese Patent Laid-Open No. 2017-000179 discloses a technique of analyzing the behavior of a golf club head and predicting the ball flight of a shot. There is also proposed a technique of recommending a golf item suitable for a golfer based on such analysis result (for example, Japanese Patent Laid-Open No. 2011-015968). Japanese Patent Laid-Open No. 2021-371 discloses a technique of estimating the behavior of a shot by measuring a swing.

The behavior of a golf club such as a head speed at the time of striking and the behavior of a shot such as the initial speed of a golf ball immediately after striking are matters of high concern for a golfer. However, such matters require dedicated measuring devices.

SUMMARY OF THE INVENTION

The present invention has as its object to provide a technique of estimating the behavior of a golf club during a swing without requiring any measuring device.

According to an aspect of the present invention, there is provided an information processing apparatus comprising:

- an acquisition unit configured to acquire a video of a swing of a golfer who strikes a golf ball with a golf club;
- a calculation unit configured to calculates a feature amount of the swing from the video; and
- a conversion unit configured to convert the feature amount into an estimated value of a behavior of a golf club head by substituting the feature amount into a conversion formula.

Further features of the present invention will become apparent from the following description of exemplary embodiments (with reference to the attached drawings).

DESCRIPTION OF THE EMBODIMENTS

Figure 1:
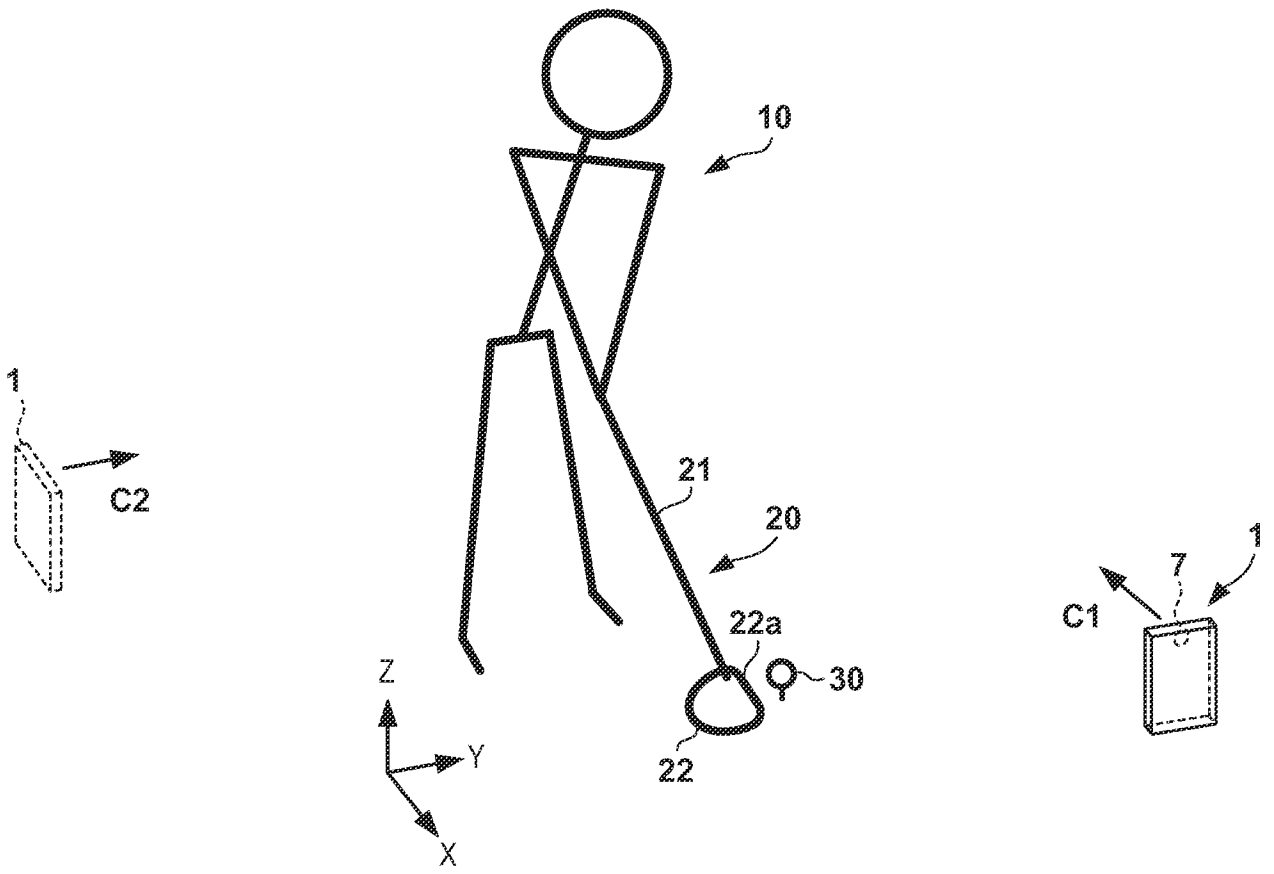
FIG. 1 is an explanatory view showing a mode of capturing a swing video by an information processing apparatus according to an embodiment of the present invention.

Hereinafter, embodiments will be described in detail with reference to the attached drawings. Note that the following embodiments are not intended to limit the scope of the claimed invention, and limitation is not made to an invention that requires all combinations of features described in the embodiments. Two or more of the multiple features described in the embodiments may be combined as appropriate. Furthermore, the same reference numerals are given to the same or similar configurations, and redundant description thereof is omitted.

First Embodiment

Information Processing Apparatus

FIG. 1 is an explanatory view showing a mode of capturing a swing video (moving image) using an information processing apparatus 1 according to an embodiment of the present invention. Arrows X, Y, and Z represent a three-dimensional coordinate system recognized or set on a video. The arrows X and Y represent horizontal directions orthogonal to each other, and the arrow Z represents the vertical direction. The arrow Y represents the target line direction (target direction) of a golf ball 30.

The information processing apparatus 1 has an image capturing function. In this embodiment, the information processing apparatus 1 is used to capture a video of a swing of a golfer 10 from a direction C1. In addition, a video of a swing of the golfer 10 is also captured from a direction C2. Therefore, the golfer 10 performs a golf swing operation twice.

The direction C1 is a direction in which the golfer 10 is captured from the front, and is the X direction. The direction C2 is a direction in which the golfer 10 is captured from the rear in the target line direction, and is the Y direction. In a golf swing operation, the golfer 10 strikes the golf ball 30 with a golf club 20. The golf club 20 includes a golf club head 22 having a face surface (striking surface) 22*a*, and a shaft 21 connected to the head 22. A grip (not shown) is attached to the end portion of the shaft 21 on the side of the golfer 10. A swing video includes a series of striking operations of the golfer, such as address, a back swing, a down swing, an impact, and a follow through.

Figure 2:
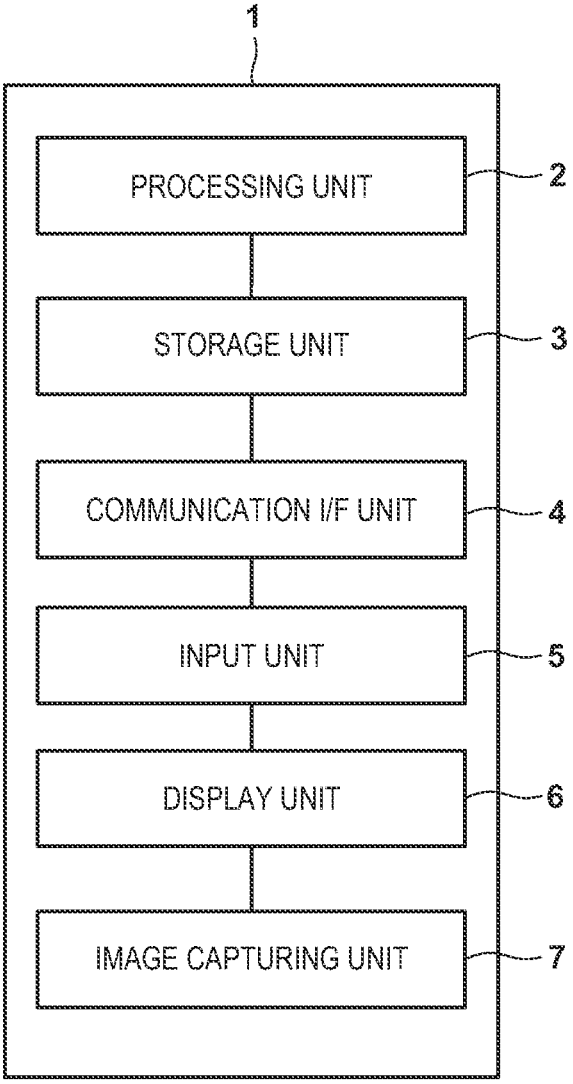
FIG. 2 is a block diagram of the information processing apparatus shown in FIG. 1.

The information processing apparatus 1 will be described with reference to FIG. 2 in addition to FIG. 1. FIG. 2 is a block diagram of the information processing apparatus 1. The information processing apparatus 1 of this embodiment is a portable terminal represented by a smartphone with a camera. The golfer 10 can capture a swing video by supporting the information processing apparatus 1 by a tripod or the like. The information processing apparatus 1 includes a processing unit 2, a storage unit 3, and a communication interface unit (communication I/F unit) 4 which are electrically connected to each other. The processing unit 2 is a processor such as a CPU. The storage unit 3 includes one or a plurality of storage devices. The storage devices are, for example, a RAM, a ROM, and the like. The storage unit 3 stores a program to be executed by the processing unit 2, and various kinds of data. The program to be executed by the processing unit 2 can be formed from a plurality of instructions readable by the processing unit 2. The communication I/F unit 4 is a communication device that executes wireless communication with an external device.

The information processing apparatus 1 also includes an input unit 5, a display unit 6, and an image capturing unit 7. The input unit 5 is a switch that accepting a user input. The display unit 6 is a touch panel that provides information by an image to the user and also accepts a user input. The image capturing unit 7 is a camera that captures an image, and includes, for example, an optical system such as a lens and an image sensor such as a CCD sensor. A swing video is captured by the image capturing unit 7.

Behavior of Golf Club Head

In this embodiment, the information processing apparatus 1 estimates the behavior of the head 22 from the swing videos. In this embodiment, the estimation contents include a head speed, the direction of the face surface (striking surface) 22*a* at the time of striking, and the incident angle of the head 22 at the time of striking. The head speed is the speed (m/s) of the head 22 at the time of striking. The head speed may be referred to as HS hereinafter.

Figure 3A:
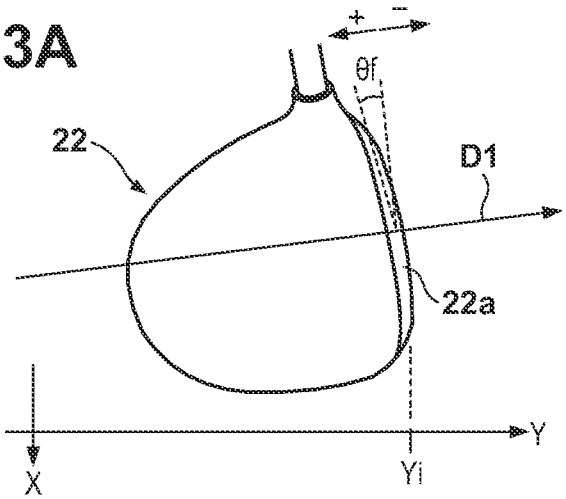
FIGS. 3A and 3B are explanatory views of the direction (face angle) of a face at the time of striking.

The direction of the face surface (striking surface) 22*a* at the time of striking is the angle (face angle) of the face surface 22*a* at the time striking. FIG. 3A is an explanatory view of this. In an example shown in FIG. 3A, an angle θf formed by a line perpendicular to a direction D1 of the moving trajectory of the head 22 at a striking position Yi of the golf ball 30 and a tangent in a toe-heel direction passing through the center of the face surface 22*a* is set as the face angle on the X-Y plane. In the example shown in FIG. 3A, an angle in a direction in which the face surface 22*a* is opened is negative, and an angle in a direction in which the face surface 22*a* is closed is positive.

Figure 3B:
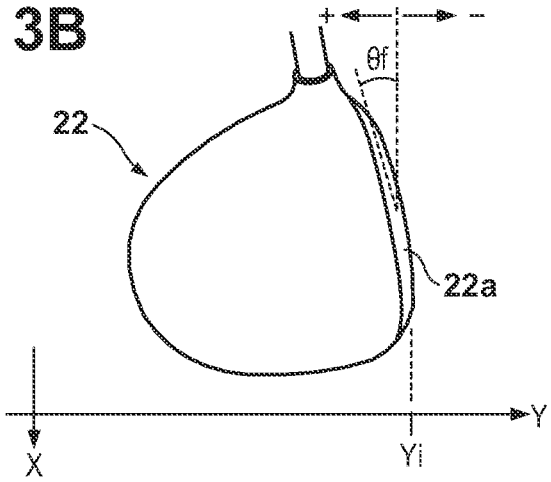

Note that the face angle may be set with reference to not the direction D1 of the moving trajectory of the head 22 but the target line direction. FIG. 3B is an explanatory view of this. An angle θf formed by a line (X direction) perpendicular to the target line direction Y at the striking position Yi of the golf ball 30 and a tangent in a toe-heel direction passing through the center of the face surface 22*a* is set as the face angle on the X-Y plane. In the example shown in FIG. 3B as well, an angle in a direction in which the face surface 22*a* is opened is negative, and an angle in a direction in which the face surface 22*a* is closed is positive.

Figure 4:
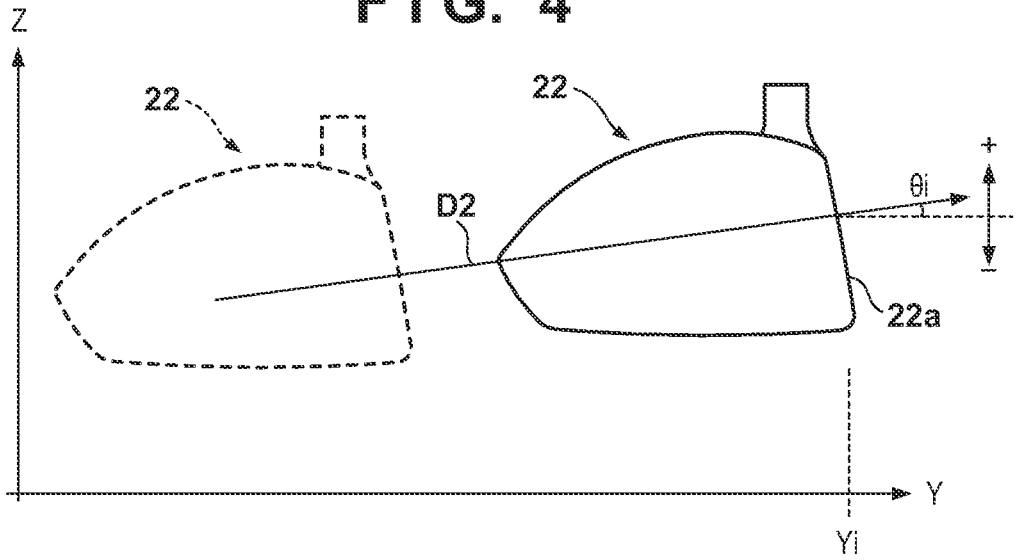
FIG. 4 is an explanatory view of an incident angle.

The incident angle is the angle of the trajectory of the head 22 in the Z direction at the time of striking the golf ball 30 with respect to the Y direction on the Y-Z plane. FIG. 4 is an explanatory view of this. In an example shown in FIG. 4, a direction D2 of the head trajectory is specified based on the position of the head 22 at the striking position Yi of the golf ball 30, and the previous position (indicated by a broken line) of the head 22, and an angle θi between the direction D2 and the Y direction represents the incident angle. In the example shown in FIG. 4, the upward direction is set as the positive direction, and the downward direction is set as the negative direction.

The estimation contents of this embodiment include the above three items but may include another behavior.

Feature Amounts of Swing

Figure 5:
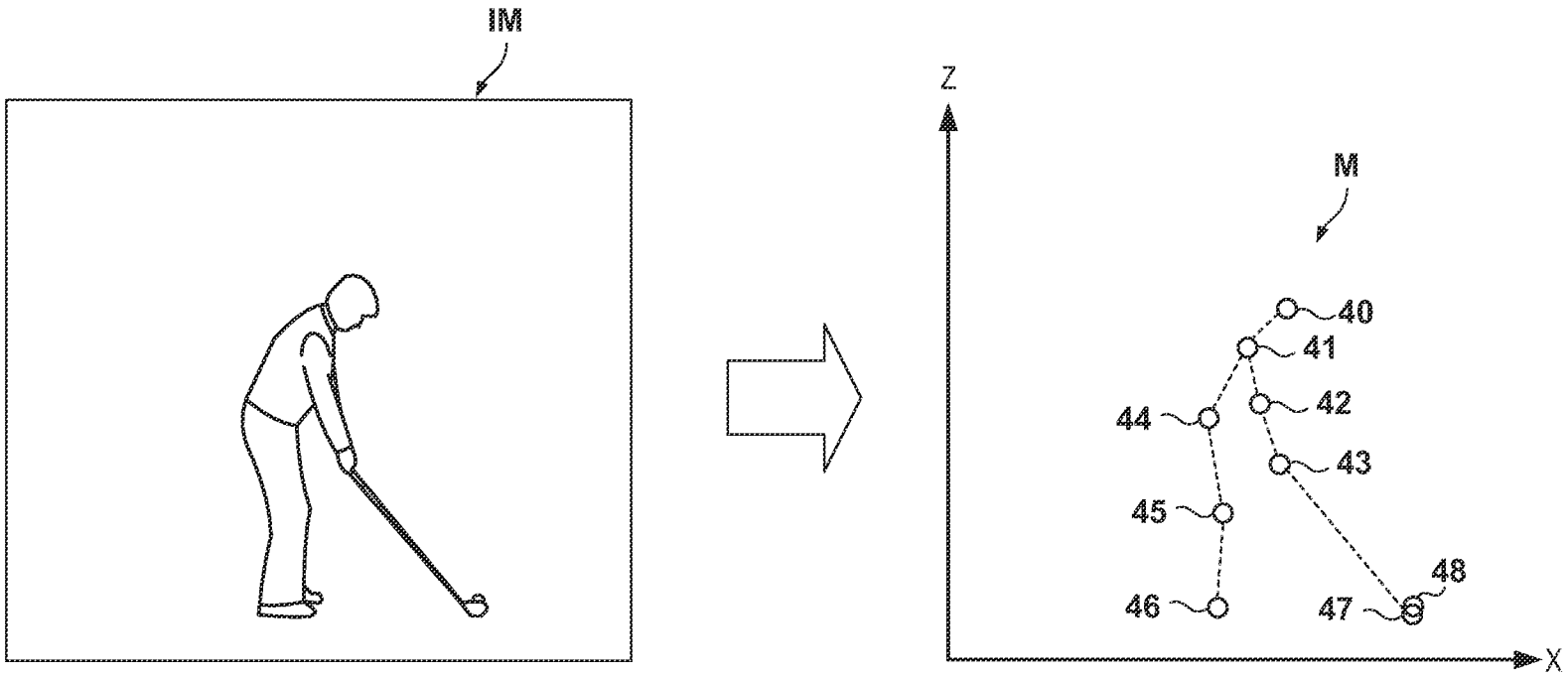
FIG. 5 is an explanatory view of video analysis.

To estimate the behavior of the head 22, in this embodiment, the feature amounts of a swing are calculated from the video captured by the image capturing unit 7, and the above three items are estimated from the calculated feature amounts. To analyze the video, for example, an image recognition technique represented by a skeleton detection technique is applied to each frame image forming the video. FIG. 5 shows an example. In the example shown in FIG. 5, the image recognition technique is applied to a swing image (a frame at the time of address) IM captured from the rear in the target line direction, thereby extracting a model M of a golfer and a golf club. The model M includes, as points of interest of the golfer, pieces of coordinate information of a head 40, a shoulder 41, an elbow 42, a wrist 43, a waist 44, a knee 45, and an ankle 46. Furthermore, the model M includes, as a point of interest of the golf club 20, coordinate information of a head portion 47 corresponding to the golf club head 22. The model M also includes coordinate information of a ball portion 48 by setting the golf ball 30 as a point of interest.

In this embodiment, three kinds of feature amounts are used as the feature amounts of the swing. The three kinds of feature amounts are all specified based on the position of the head 22 on the video, that is, the coordinates of the head portion 47. Furthermore, some feature amounts are specified based on the position of the head 22 (the coordinates of the head portion 47) and the body parts of the golfer.

Figure 6B:
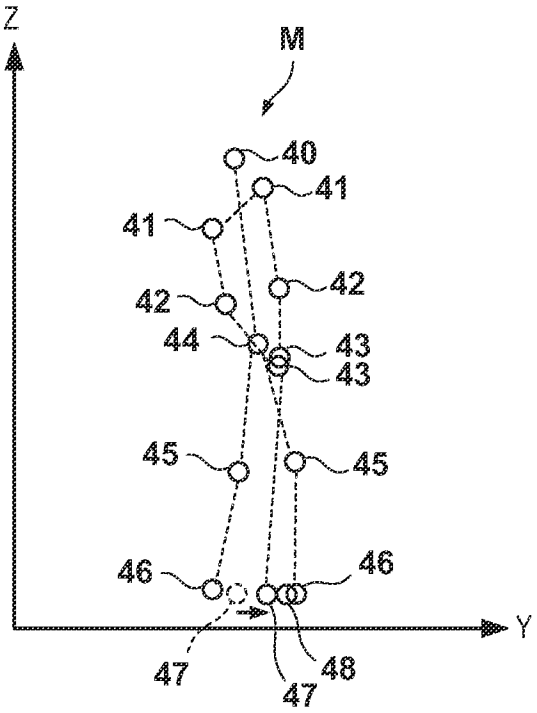
FIGS. 6A and 6B are explanatory views of a feature amount (moving velocity)
Figure 6A:
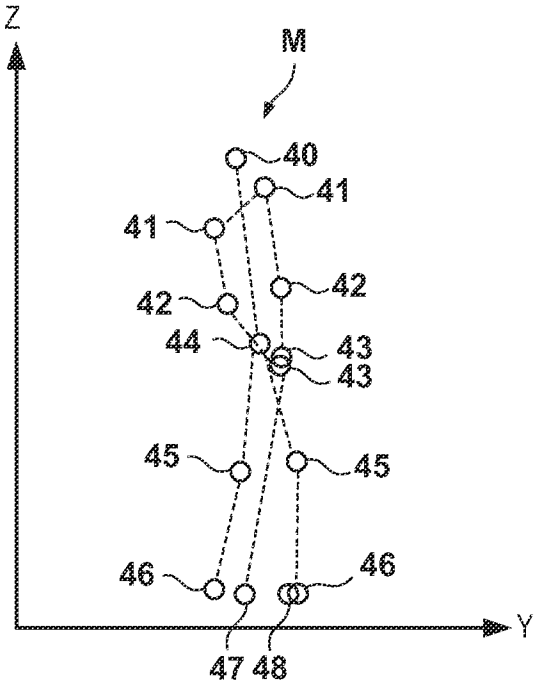

The first one of the three kinds of feature amounts is a moving velocity MV of the head 22 in the target line direction on the image at the time of striking, and is calculated from the video captured from the direction C1. FIGS. 6A and 6B are explanatory views of this. FIG. 6A shows the model M extracted from a frame image immediately before striking, and FIG. 6B shows the model M extracted from a frame image at the time of striking. In the stage shown in FIG. 6A, the head portion 47 is located on the rear side of the ball portion 48. The stage shown in FIG. 6B shows a state immediately before the head portion 47 contacts the ball portion 48. The moving velocity MV can be calculated based on the frame rate of the video and the moving distance (the difference in the Y and Z coordinates) of the head portion 47 in the Y and Z directions between the two models M. The moving distance can be specified as an actual distance based on the ratio between the actual measured length of a reference object in the image and the length of the reference object in the image and the moving distance of the head portion 47 in the image. Examples of the reference object are the golfer, the golf club, and the like. If the golfer is set as the reference object, the height of the golfer or a part (the length of an arm, the length of a leg, or the like) of the body of the golfer may be specified. If the golf club is set as the reference object, the overall length of the golf club, or a part (the length of the shaft, the length of the grip, or the like) of the golf club may be specified. According to the research by the present inventors, the moving velocity MV is correlated with the head speed among the behavior items of the head 22.

Figure 7B:
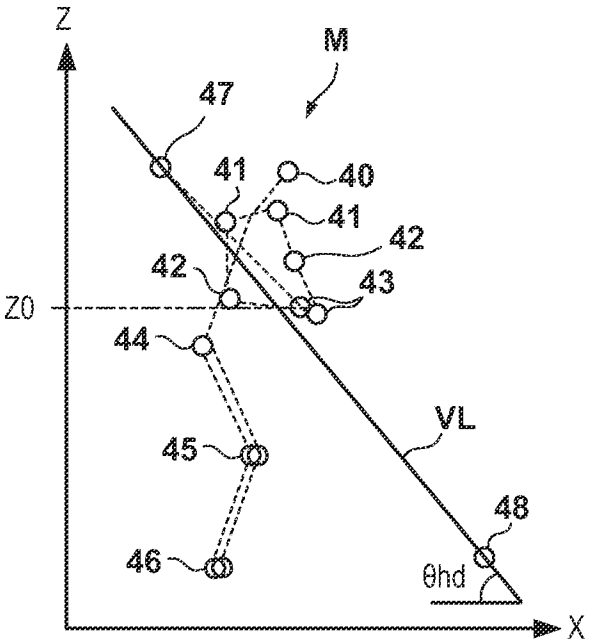
FIGS. 7A and 7B are explanatory views of a feature amount (virtual line angle)
Figure 7A:
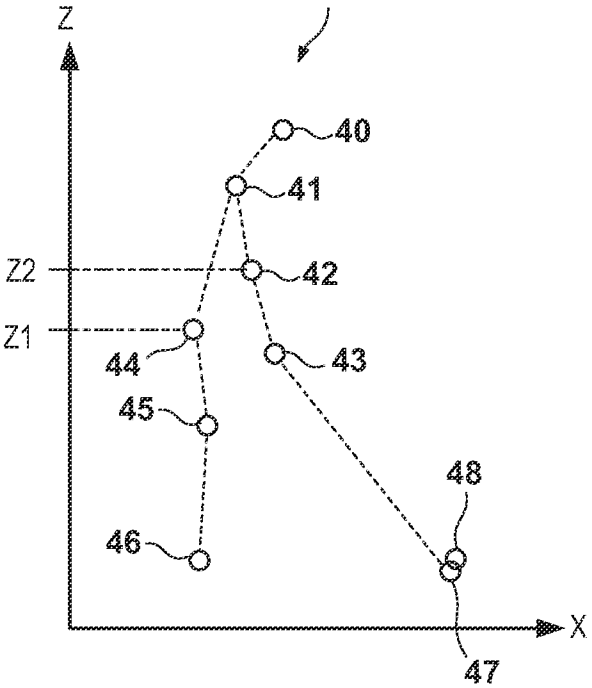

The second one of the three kinds of feature amounts is an angle θhd of a virtual line passing through the head 22 and the ball 30 on the video with respect to the ground (X-axis) at a predetermined timing (to be referred to as a determination timing hereinafter) during a down swing, and is calculated from the video captured from the direction C2. FIGS. 7A and 7B are explanatory views of this. FIG. 7A shows the model M extracted from a frame image at the time of address, and FIG. 7B shows the model M extracted from a frame image at the determination timing. The model M shown in FIG. 7A is used to define the determination timing.

In this embodiment, the determination timing is defined based on the positions of the waist and elbow of the golfer 10 in the Z direction at the time of address and the position of the wrist of the golfer 10 in the Z direction at the time of the down swing, and a timing at which the swing operation is in the vicinity of the halfway down position is defined as the determination timing. More specifically, a Z-axis coordinate Z1 of the waist 44 and a Z-axis coordinate Z2 of the elbow 42 at the time of address are specified from the model M shown in FIG. 7A. As shown in FIG. 7B, the determination timing is a timing at which the Z-axis coordinate of the wrist 43 during the down swing is closest to Z0. At this time, Z0=(Z1+Z2)/2. In the model M shown in FIG. 7B, a virtual line VL passing through the head portion 47 and the ball portion 48 is drawn, and the angle θhd of the virtual line VL with respect to the ground (X direction) is calculated. According to the research by the present inventors, the angle θhd is correlated with the face angle among the behavior items of the head 22.

Figure 8B:
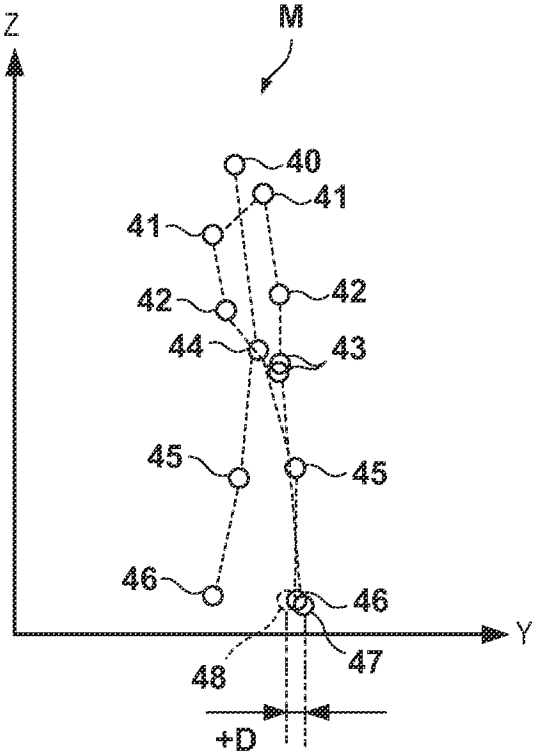
FIGS. 8A and 8B are explanatory views of a feature amount (the distance of the lowest point)
Figure 8A:
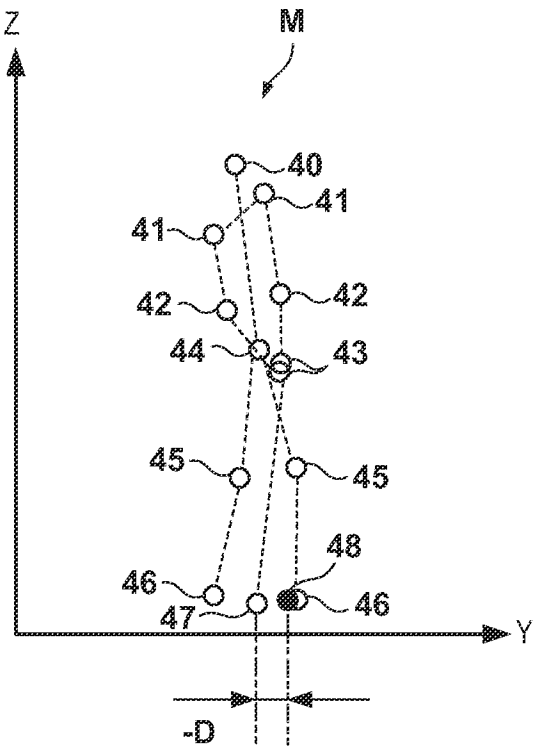

The third one of the three kinds of feature amounts is a distance D in the target line direction between the golf ball 30 and the head 22 at the lowest point after a back swing, and is calculated from the video captured from the direction C1. FIG. 8A is an explanatory view of this. FIG. 8A shows the model M when the head 22 is located at the lowest point in the Z direction, among the models M extracted from a plurality of frame images before and after striking. FIG. 8A shows an example in which the head 22 is located at the lowest point before striking. FIG. 8B shows another example, and shows an example in which the head 22 is located at the lowest point after striking. Whether the distance D is positive or negative is determined with reference to the position of the golf ball 30 before striking, that is, the Y-axis coordinate of the ball portion 48. If the head portion 47 reaches the lowest point on the Z axis before striking, as shown in FIG. 8A, the distance D has a negative value, and if the head portion 47 reaches the lowest point after striking, as shown in FIG. 8B, the distance D has a positive value. Similar to calculation of the moving distance of the head portion 47 at the moving velocity MV, the distance D can be specified as the actual distance based on the ratio between the actual measured length of the reference object in the image and the length of the reference object in the image and the distance between the golf ball 30 and the head 22 located at the lowest point in the image. According to the research by the present inventors, the distance D is correlated with the incident angle among the behavior items of the head 22.

Conversion from Feature Amount into Estimated Value of Head Behavior

Figure 9:
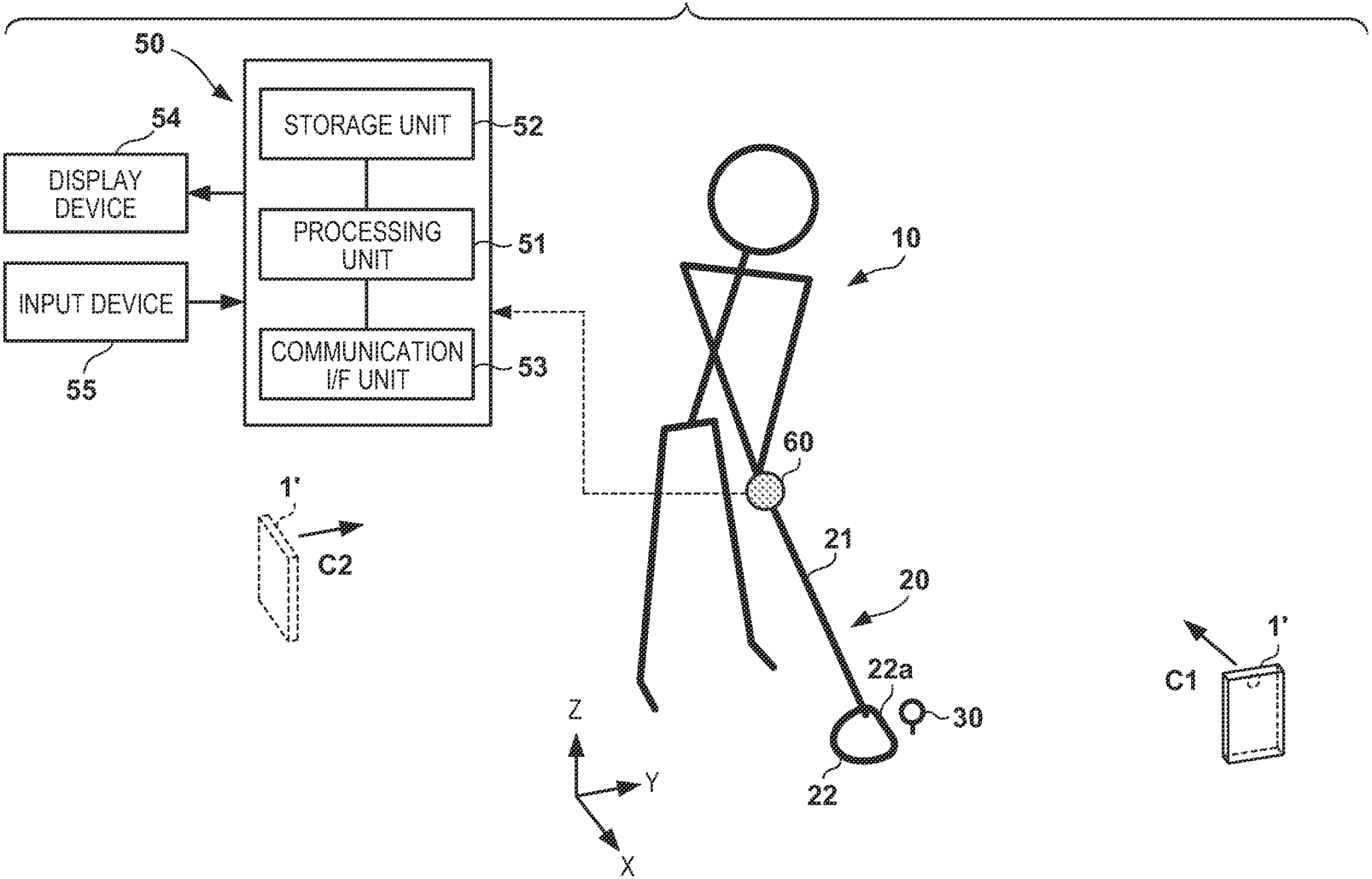
FIG. 9 is an explanatory view of a measurement system for measuring a head behavior.

By defining, in advance, by the form of a conversion formula, the correlation between the feature amount of the swing and the actual measured value of the behavior of the head 22, it is possible to obtain the estimated value of the behavior of the head 22 by capturing swing videos. To obtain the conversion formula, a striking test is done in advance. A plurality of testers can make striking tests. FIG. 9 shows an example of the arrangement of a measurement system used for a striking test.

A measuring device 60 is a device that measures the golf swing operation of the golfer 10. In this embodiment, the measuring device 60 is a device that measures the behavior of the golf club 20. The measuring device 60 is a device attached to the shaft 21 (or grip) of the golf club 20, and incorporates an acceleration sensor and an angular velocity sensor. As the measuring device 60, for example, TSND121 available from ATR-Promotions or M-tracer available from Seiko Epson Corporation can be used. As a result of detection of the measuring device 60, time-series data of the three-dimensional acceleration and three-dimensional angular velocity of the golf club 20 during a swing are obtained.

An image capturing apparatus 1' captures a video of a swing of the golfer 10. The image capturing apparatus 1' may be a portable terminal with a camera, similar to the information processing apparatus 1. The image capturing apparatus 1' is used to capture a video of a swing of the golfer 10 from each of the directions C1 and C2.

An information processing apparatus 50 is an apparatus that generates the above conversion formula from the measurement result of the measuring device 60 and the swing videos captured by the image capturing apparatus 1'. The information processing apparatus 50 includes a processing unit 51, a storage unit 52, and a communication interface unit (communication I/F unit) 53 which are electrically connected to each other. The processing unit 51 is a processor such as a CPU. The storage unit 52 includes one or a plurality of storage devices. The storage devices are, for example, a RAM, a ROM, and the like. The storage unit 52 stores a program to be executed by the processing unit 51, and various kinds of data. The program to be executed by the processing unit 51 can be formed from a plurality of instructions readable by the processing unit 51. The communication I/F unit 53 is a communication device that executes wireless communication with an external device.

A display device 54 and an input device 55 are connected to the information processing apparatus 50. The display device 54 is, for example, an electronic image display device such as a liquid crystal display device, and displays the processing result of the information processing apparatus 50. The input device 55 includes a mouse and a keyboard, and accepts a data input and an operation instruction for the information processing apparatus 50.

Figure 10A:
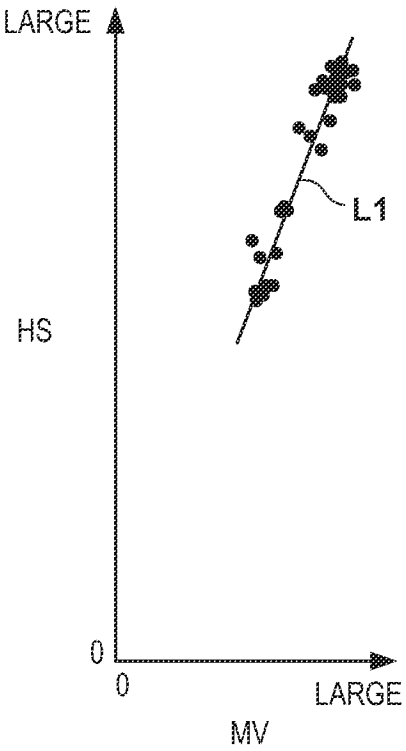
FIGS. 10A to 10C are explanatory views each showing an example of deriving a conversion formula.
Figure 10B:
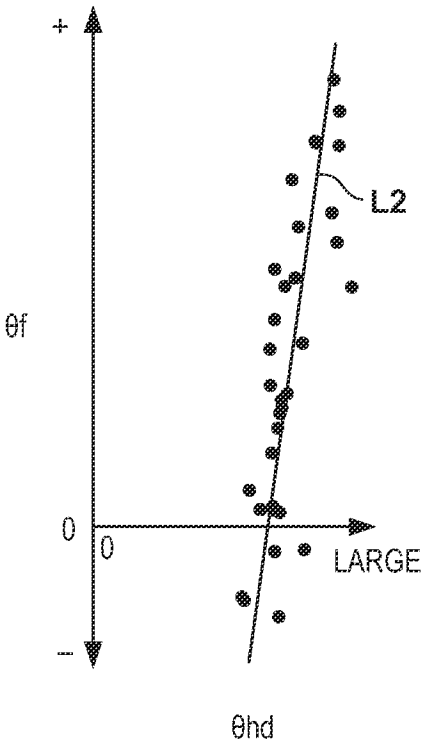
Figure 10C:
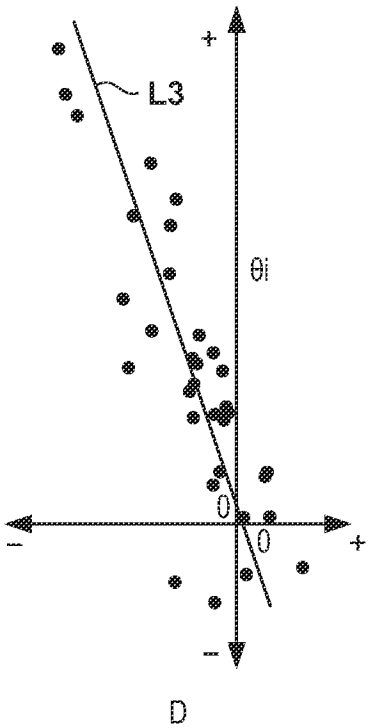

The information processing apparatus 50 receives the measurement result of the measuring device 60. The processing unit 51 calculates, from the measurement result, the head speed HS, the face angle θf described with reference to FIG. 3A, and the incident angle θi described with reference to FIG. 4. With respect to the measured swing, the swing videos captured by the image capturing apparatus 1' are input. The processing unit 51 analyzes the swing videos to calculate the moving velocity MV, the angle θhd, and the distance D described with reference to FIGS. 6A to 8B. A pair of the head speed HS and the moving velocity MV, a pair of the face angle θf and the angle θhd, and a pair of the incident angle θi and the distance D are stored in the storage unit 52. By repeating a striking test, a number of pairs of data are obtained. The conversion formula (arithmetic formula) is generated from the pairs of data. FIGS. 10A to 10C show examples.

FIG. 10A shows a data group of the pairs of the head speeds HS and the moving velocities MV. An approximate straight line L1 representing the correlation between the head speed HS and the moving velocity MV is derived by regression analysis, and a linear equation: $HS=\alpha1\times MV+\beta1$ ($\alpha1$ and $\beta1$ are coefficients) with the head speed HS as a target variable and the moving velocity MV as an explanatory variable is derived from the approximate straight line L1. This equation is set as the conversion formula for obtaining the head speed HS from the moving velocity MV.

FIG. 10B shows a data group of the pairs of the face angles θf and the angles θhd. Similar to the case shown in FIG. 10A, an approximate straight line L2 representing the correlation between the face angle θf and the angle θhd is derived by regression analysis, and a linear equation: $\theta f=\alpha2\times\theta hd+\beta2$ ($\alpha2$ and $\beta2$ are coefficients) with the face angle θf as a target variable and the angle θhd as an explanatory variable is derived from the approximate straight line L2. This equation is set as the conversion formula for obtaining the face angle θf from the angle θhd.

FIG. 10C shows a data group of the pairs of the incident angles θi and the distances D. Similar to the case shown in FIG. 10A, an approximate straight line L3 representing the correlation between the incident angle θi and the distance D is derived by regression analysis, and a linear equation: $\theta i=\alpha3\times D+\beta3$ ($\alpha3$ and $\beta3$ are coefficients) with the incident angle θi as a target variable and the distance D as an explanatory variable is derived from the approximate straight line L3.

As described above, it is possible to obtain the estimated values of the behavior of the head 22 by substituting the feature amounts calculated from the swing videos into the conversion formulas.

Estimation of Behavior of Shot

If the behavior of the head 22 is estimated from the swing videos, the behavior of the shot can also be estimated. The ball flight of the golf ball 30 struck by a golf swing operation of the golfer 10 is important for him/her. The ball flight of the golf ball 30 is estimated based on the behavior of the shot such as the initial speed, the vertical and horizontal launch angles, the back spin amount, and the side spin amount of the golf ball 30 immediately after striking. The behavior of the shot can be actually measured by a measuring facility such as a doppler radar. In this embodiment, however, the ball flight of the golf ball 30 can also be estimated by performing a procedure of swing videos→extraction of the feature amounts→estimation of the behavior of the head 22→estimation of the behavior of the golf ball 30. Note that since the video captured from the direction C1 and the video captured from the direction C2 are used as the swing videos, estimation of the behavior of the head 22 and estimation of the behavior of the golf ball 30 are not performed by one golf swing. However, for example, each estimation operation is performed by processing, as the same golf swing, the two golf swings of the videos captured from the directions C1 and C2.

Figure 11A:
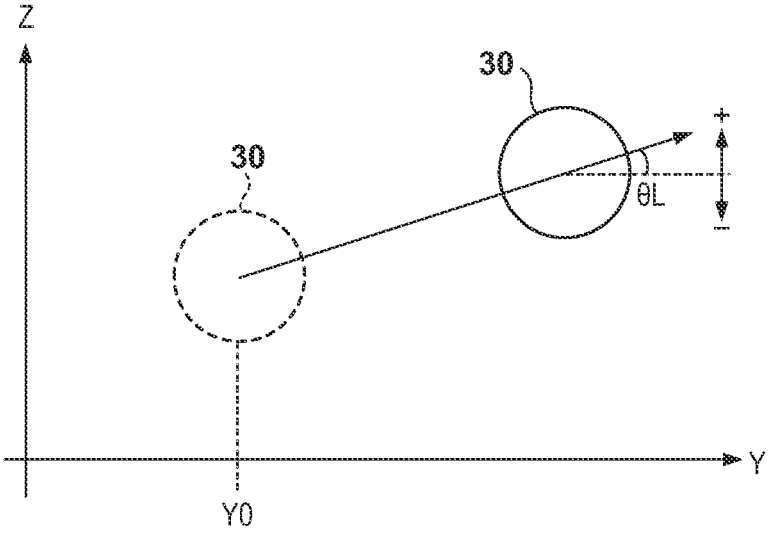
FIGS. 11A and 11B are explanatory views each showing the launch angle of a shot.
Figure 11B:
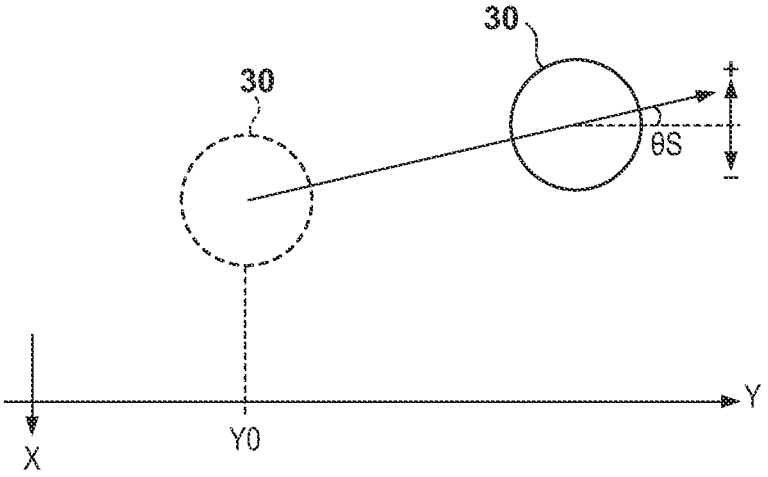

In this embodiment, as an advance preparation, a conversion formula (arithmetic formula) for converting the estimated value of the behavior of the head 22 into the estimated value of the behavior of the golf ball 30 is generated. The initial speed of the shot is the speed of the golf ball 30 immediately after striking. FIG. 11A is an explanatory view of the vertical launch angle, and FIG. 11B is an explanatory view of the horizontal launch angle. As shown in FIG. 11A, the vertical launch angle is an angle θL of the trajectory of the golf ball 30 in the Z direction immediately after striking with respect to the Y direction on the Y-Z plane. A position Y0 is the initial position (the resting position before striking) of the golf ball 30. In the example shown in FIG. 11A, the upward direction is set as the positive direction and the downward direction is set as the negative direction. As shown in FIG. 11B, the horizontal launch angle is an angle θS of the trajectory of the golf ball 30 in the X direction immediately after striking with respect to the Y direction on the X-Y plane. In the example shown in FIG. 11B, the left direction is set as the positive direction and the right direction is set as the negative direction.

Figure 12A:
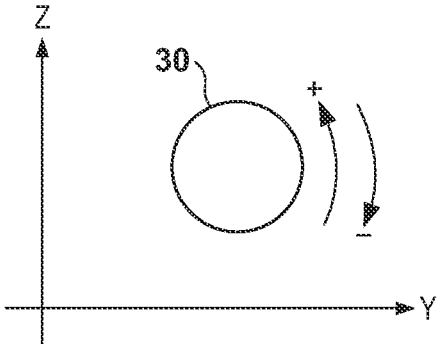
FIGS. 12A and 12B are explanatory views each showing the spin amount of a shot.
Figure 12B:
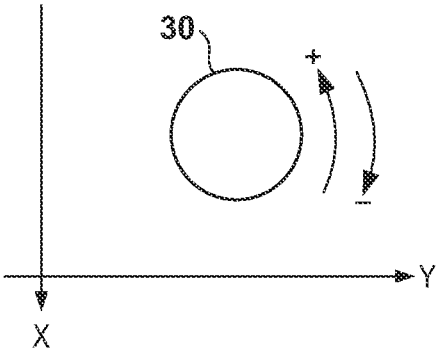

FIG. 12A is an explanatory view of the back spin amount. The back spin amount is the rotation amount of the golf ball 30 around the X-axis immediately after striking. In an example shown in FIG. 12A, rotation in the upward direction is positive and rotation in the downward direction is negative. FIG. 12B is an explanatory view of the side spin amount. The side spin amount is the rotation amount of the golf ball 30 around the Z-axis immediately after striking. In an example shown in FIG. 12B, rotation in the hook direction is positive, and rotation in the slice direction is negative.

Figure 13:
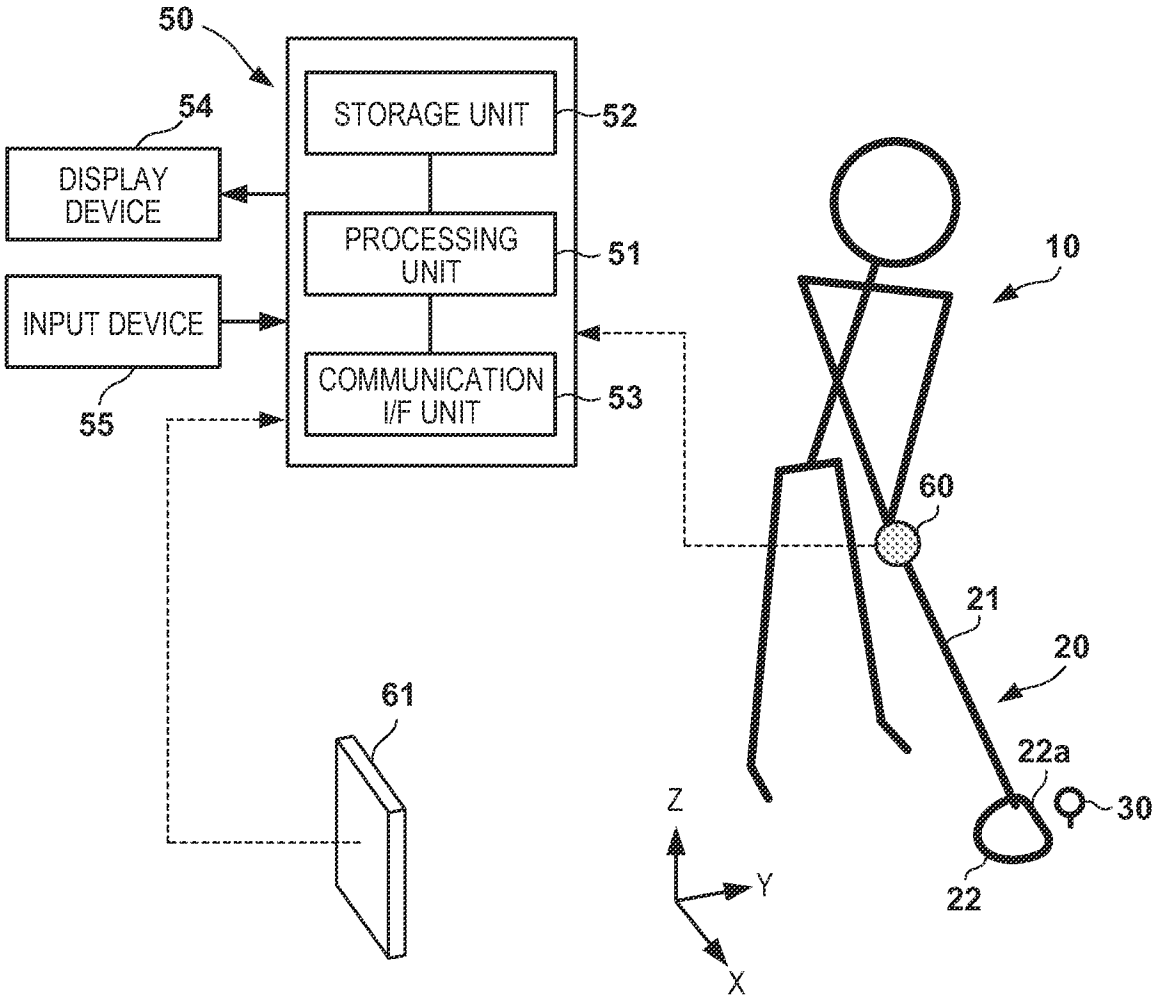
FIG. 13 is an explanatory view of a measurement system for measuring the ball flight of a shot.

The conversion formula can be generated using an actual measured data group constituted by the data group of the explanatory variable and an actual measured data group of the corresponding target variable. In this embodiment, the explanatory variables are the head speed HS, the face angle θf, and the incident θi, and the target variables are the initial speed, the vertical launch angle, the horizontal launch angle, the back spin amount, and the side spin amount of the golf ball 30. The target variables are actually measured by the ball flight measuring facility such as a high-speed camera or a doppler radar. For example, TRACKMAN available from TRACKMAN can be used. FIG. 13 shows an example of the arrangement of a measurement system used for a striking test for obtaining a conversion formula, which is obtained by adding a ball flight measuring device 61 to the system shown in FIG. 9. Data of a set of the head speed HS, face angle θf, the incident angle θi, the initial speed of the ball, the vertical launch angle, the horizontal launch angle, the back spin amount, and the side spin amount can be obtained from the measurement results of the measuring device 60 and the ball flight measuring device 61. By repeating a striking test, a number of sets of data are obtained.

The conversion formula can be derived by, for example, machine learning using the data group as supervised data. Examples of an algorithm of machine learning are linear regression using stochastic gradient descent, ridge regression, lasso regression, support vector regression, and deep learning. For linear regression using stochastic gradient descent, ridge regression, or lasso regression, if the target variable is represented by y, the explanatory variable is represented by x, and a coefficient is represented by a, a linear formula can be used as the arithmetic formula, given by:

$$y1=a1\cdot x1+a2\cdot x2+a3\cdot x3$$

Then, the coefficient a is obtained by machine learning, thereby completing the arithmetic formula. For lasso regression or deep learning, the formula and the coefficients in the formula can be obtained by machine learning. For lasso regression, the type of explanatory variable used finally can also be determined by machine learning.

According to an experiment related to this embodiment, among the explanatory variables, especially the head speed HS, the face angle θf, and the incident angle θi were correlated with the initial speed of the ball, the vertical and horizontal launch angles, the back spin amount, and the side spin amount. The conversion formulas can be represented by linear formulas, given by:

initial speed of ball=$a1$·head speed HS+$a2$·incident angle $\theta i$+$a3$·face angle $\theta f$+$a0$ vertical launch angle=$a11$·head speed HS+$a12$·incident angle $\theta i$+$a13$·face angle $\theta f$+$a10$ horizontal launch angle=$a21$·head speed HS+$a22$·incident angle $\theta i$+$a23$·face angle $\theta f$+$a20$ back spin amount=$a31$·head speed HS+$a32$·incident angle $\theta i$+$a33$·face angle+$a30$ side spin amount=$a41$·head speed HS+$a42$·incident angle $\theta i$+$a43$·face angle+$a40$ Note that the conversion formulas may be derived by a method other than machine learning, for example, correlation analysis.

Processing Example

Figure 14:
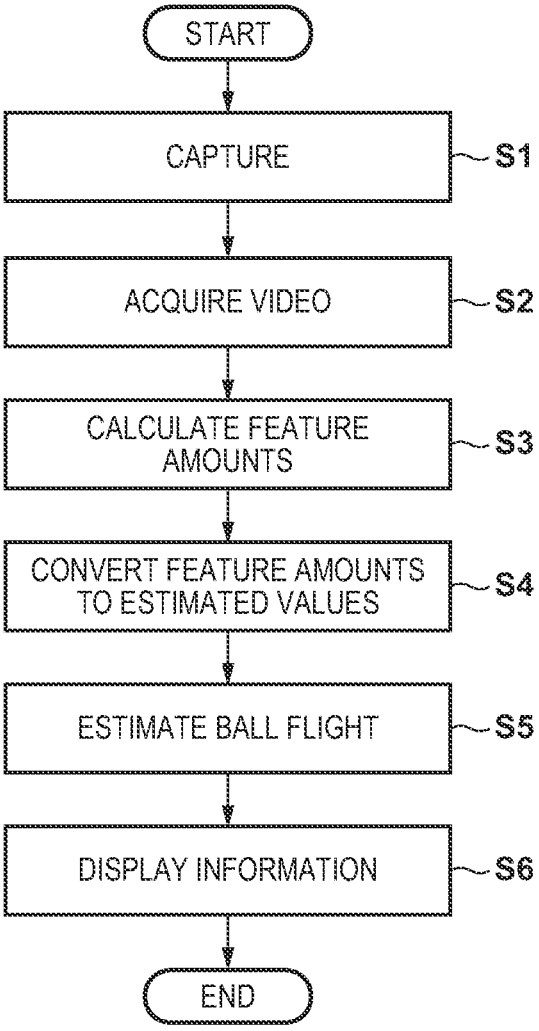
FIG. 14 is a flowchart illustrating an example of the processing of the information processing apparatus.

An example of the processing of the information processing apparatus 1 will be described. FIG. 14 is a flowchart illustrating an example of the processing of the processing unit 2, and shows processing of displaying a ball flight estimation result of a shot from the swing videos. The program of this processing is stored in the storage unit 3, and each conversion formula obtained in advance is described in the program or is stored in the storage unit 3 and then read out and used.

In step S1, the image capturing unit 7 of the information processing apparatus 1 captures swing videos from the directions C1 and C2 described with reference to FIG. 1. Data of the captured swing videos are saved in the storage unit 3.

In step S2, the data of the swing videos are acquired from the storage unit 3. In step S3, the feature amounts are calculated from the acquired swing videos. The calculated feature amounts are the moving velocity MV, the angle θhd, and the distance D. In step S4, the feature amounts calculated in step S3 are converted into the head speed HS, the face angle θf, and the incident angle θi using the respective conversion formulas described with reference to FIGS. 10A to 10C.

Figure 12C:
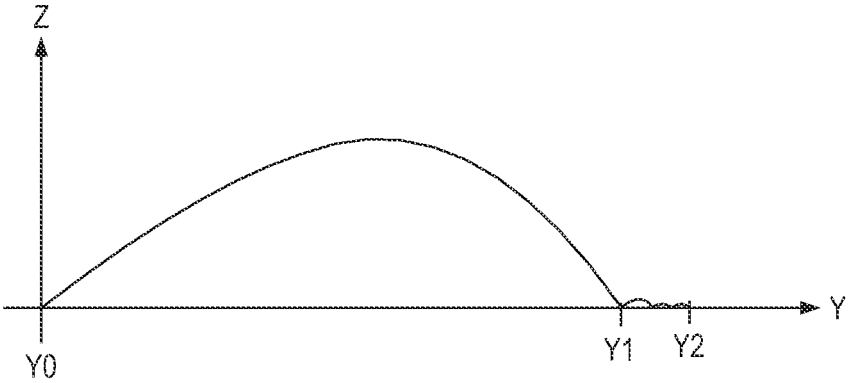
FIGS. 12C and 12D are explanatory views each showing the ball flight.
Figure 12D:
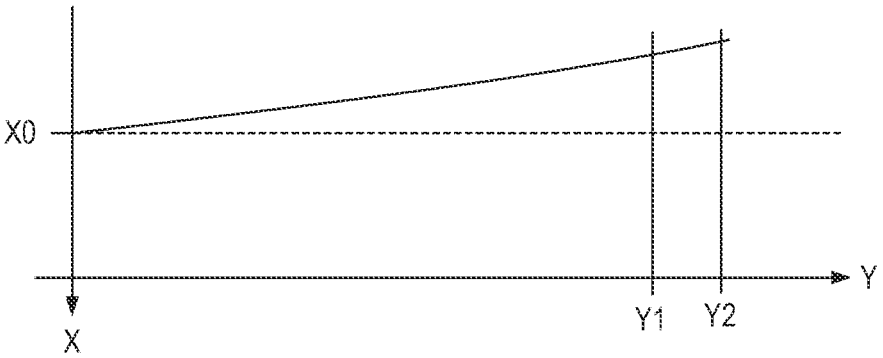

In step S5, the ball flight of the golf ball 30 is estimated. In estimating the ball flight, the estimated values obtained in step S4 are converted into the initial speed, the vertical launch angle, the horizontal launch angle, the back spin amount, and the side spin amount of the golf ball 30 using the above conversion formulas. An example of contents of the estimated ball flight can be a distance of the shot in the target line direction (Y direction). FIG. 12C shows an example of the ball flight of the shot in the target line direction, and a distance from the position Y0 (initial position) to a position Y1 indicates a carry (flight distance) and a distance from the position Y1 to a position Y2 indicates a run (a rolling distance on the ground). The distance of the shot may include only the carry or may be the total value of the carry and the run. An example of contents of the estimated ball flight can be a deflection of the shot in the horizontal direction (X direction). FIG. 12D shows an example of the ball flight of the shot in the horizontal direction, in which a position X0 indicates the initial position (striking position) of the golf ball 30. A broken line in the Y direction passing through the position X0 indicates a direction in which the ball is hit, and a deflection when the ball stops on this line is set to 0. In the example shown in FIG. 12D, the ball flight is deflected leftward.

Referring back to FIG. 14, in step S6, the estimation result is displayed on the display unit 6. The displayed information includes the ball flight estimation result in step S5 as well as the videos in step S2, information of the model M, the feature amounts calculated in step S3, and the estimated values converted in step S4.

As described above, in this embodiment, it is possible to estimate the behavior of the golf club 20, especially, the head 22 from the swing videos, and also estimate the ball flight of the golf ball 30 using the estimation result. Since it is only necessary to capture swing videos without requiring dedicated measuring devices such as the measuring devices 60 and 61, a golfer having a portable terminal with a camera or the like can readily obtain information concerning a swing of himself/herself.

Second Embodiment

Figure 15A:
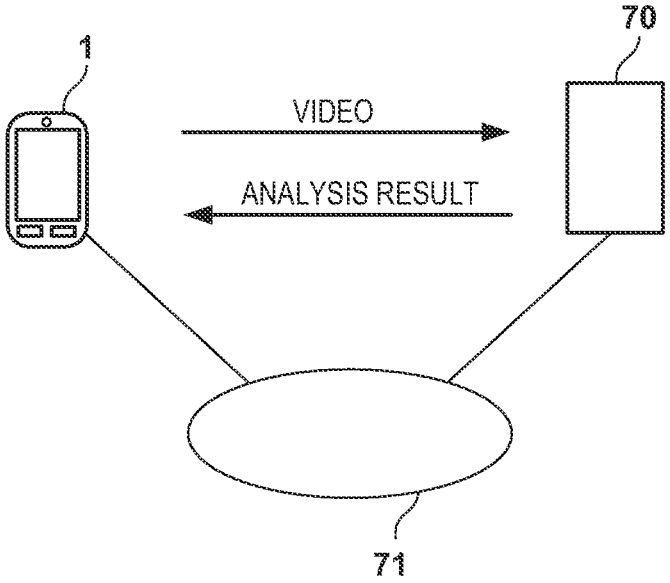
FIGS. 15A and 15B are views showing other examples of an information processing apparatus.

In the first embodiment, all processes from processing of capturing swing videos to processing of displaying a result are performed using the information processing apparatus 1 but some of the processes may be performed using another information processing apparatus. FIG. 15A shows an example. In a system shown in FIG. 15A, an information processing apparatus 1 can communicate with an information processing apparatus (server) 70 via a network 71 such as the Internet. The server 70 performs processes in steps S2 to S5 among processes shown in FIG. 14. More specifically, the information processing apparatus 1 captures swing videos in step S1, and transmits the captured swing videos to the server 70. The server 70 acquires (receives) the swing videos in step S2, and performs the processes in steps S3 to S5. Then, the server 70 transmits a processing result to the information processing apparatus 1. Upon receiving the processing result, the information processing apparatus 1 performs information display processing in step S6.

As another example, the server 70 may acquire (receive) the swing videos transmitted from the information processing apparatus 1 in step S2, perform processing up to extraction of information of a model M by the image recognition technique, and transmit the information of the model M to the information processing apparatus 1. The information processing apparatus 1 performs the processes in steps S3 to S6 based on the received information of the model M.

As described above, it is possible to reduce the processing load of the information processing apparatus 1 by adopting the server-client system. In addition, since the server 70 unitarily manages conversion formulas, it is easy to update them.

Figure 15B:
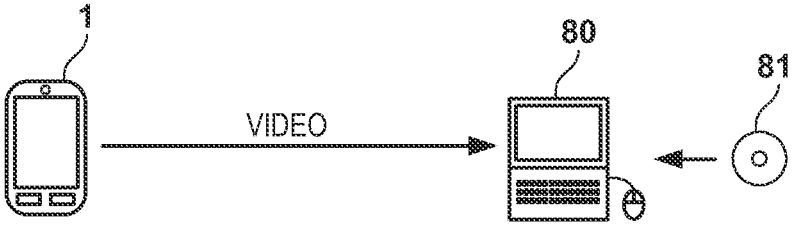

FIG. 15B shows another example of the arrangement. In a system shown in FIG. 15B, the information processing apparatus 1 is used only as a camera, and captured swing videos are provided to an information processing apparatus 80 such as a personal computer held by a golfer. For example, the swing videos can be accumulated in the storage device of the information processing apparatus 80 from the information processing apparatus 1 by a USB memory or wireless communication, and acquired by the processor of the information processing apparatus 80.

The information processing apparatus 80 performs the processes in steps S2 to S6 among the processes shown in FIG. 14. The program can be installed on the information processing apparatus 80 from a storage medium 81 such as a CD-ROM.

While an embodiment has been described, the invention is not limited to the foregoing embodiments, and various variations/changes are possible within the spirit of the invention.

What is claimed is:

1. An information processing apparatus comprising a storage device storing a program and a processor configured to execute the program to cause the apparatus to perform:

acquiring a video of a swing of a golfer who strikes a golf ball with a golf club;

calculating a feature amount of the swing from the video; and converting the feature amount into an estimated value of a behavior of a golf club head by substituting the feature amount into a conversion formula.

2. The apparatus according to claim 1, wherein the feature amount is specified based on a position of the golf club head on the video.

3. The apparatus according to claim 1, wherein the feature amount is specified based on a position of the golf club head on the video and a position of a body part of the golfer.

4. The apparatus according to claim 1, wherein the video includes a video obtained by capturing the golfer from the front, the feature amount includes a moving velocity of the golf club head in a target line direction at the time of striking, and the estimated value is a head speed of the golf club head at the time of striking, which is converted from the moving velocity.

5. The apparatus according to claim 1, wherein the video includes a video obtained by capturing the golfer from the rear in a target line direction, the feature amount is an angle of a virtual line passing through the golf club head and the golf ball on the video with respect to the ground at a predetermined timing during a down swing, and the estimated value is a direction of a face surface of the golf club head at the time of striking, which is converted from the angle.

6. The apparatus according to claim 5, wherein the predetermined timing is defined based on positions of a waist and an elbow of the golfer in a vertical direction at the time of address and a position of a wrist of the golfer in the vertical direction at the time of the down swing.

7. The apparatus according to claim 1, wherein the video includes a video obtained by capturing the golfer from the front, the feature amount includes a distance in a target line direction between the golf ball and the golf club head at a lowest point, and the estimated value is an incident angle of the golf club head at the time of striking, which is converted from the distance.

8. The apparatus according to claim 1, wherein the conversion formula is a linear equation obtained from the feature amount calculated from videos of swings of a plurality of golfers, and measured values of the behavior of the golf club head measured by a measuring device during the swings.

9. The apparatus according to claim 1, further comprising an estimation unit configured to estimate a behavior of a shot by the swing based on the estimated value.

10. An information processing method comprising:

acquiring a video of a swing of a golfer who strikes a golf ball with a golf club;

calculating a feature amount of the swing from the video; and converting the feature amount into an estimated value of a behavior of a golf club head by substituting the feature amount into a conversion formula.

11. A storage medium storing a program for causing a computer to execute a method, the method comprising:

acquiring a video of a swing of a golfer who strikes a golf ball with a golf club;

calculating a feature amount of the swing from the video; and converting the feature amount into an estimated value of a behavior of a golf club head by substituting the feature amount into a conversion formula.

* * * * *